US006574832B1

(12) United States Patent
Boerger et al.

(10) Patent No.: US 6,574,832 B1
(45) Date of Patent: Jun. 10, 2003

(54) YIELDABLE GUIDE FOR A DOOR

(75) Inventors: James C. Boerger, Racine, WI (US); Mark G. Petri, Mequon, WI (US); Robert J. Harter, LaCrosse, WI (US); John K. Olthafer, Platteville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/580,154

(22) Filed: May 30, 2000

(51) Int. Cl.[7] ..... A47H 15/00; E05D 15/00

(52) U.S. Cl. ..... 16/90; 16/DIG. 1; 16/94 R; 16/96 R; 160/271

(58) Field of Search ..... 16/90, DIG. 1, 16/87 R, 94 R, 96 R, 96 L, 87 B; 49/197; 248/548; 160/270, 271, 273.1, 201

(56) References Cited

U.S. PATENT DOCUMENTS

| | | | | | |
|---|---|---|---|---|---|
| 5,482,104 | A | * | 1/1996 | Lichy | 160/273.1 |
| 5,535,805 | A | * | 7/1996 | Kellogg et al. | 160/201 |
| 5,638,883 | A | * | 6/1997 | Schulte | 160/271 |
| 5,887,385 | A | * | 3/1999 | Horner et al. | 160/201 |
| 6,053,237 | A | * | 4/2000 | Bertilsson et al. | 160/205 |

FOREIGN PATENT DOCUMENTS

| | | | |
|---|---|---|---|
| EP | 0 922 650 A2 | | 12/2000 |
| WO | WO-98/48139 | * | 10/1998 |

OTHER PUBLICATIONS

*International Search Report* corresponding to International patent Application Ser. No. PCT/US 01/17276, dated Oct. 22, 2001, 7 pages.

* cited by examiner

*Primary Examiner*—Chuck Y. Mah
(74) *Attorney, Agent, or Firm*—Marshall, Gerstein & Borun

(57) ABSTRACT

A flexible guide for a door includes straps that are mounted in pairs along either side of a doorway. The straps for each pair are generally parallel, facing each other, and spaced apart to create a gap or channel between the two. As the door opens and closes, the straps guide the vertical movement of a door panel that travels within the channel. The straps are pulled in tension between upper and lower anchors to provide the straps with enough stiffness to effectively hold the door panel within the channel under normal operation. In some embodiments, springs are used to maintain the tension in the straps. The straps are also sufficiently pliable and resilient to allow an impact to dislodge the door panel out from within the channel without damage. The upper or lower anchor is moveable between a normally extended position and a yielded position to prevent an impact from breaking the anchor and may further be biased to the normal position.

23 Claims, 11 Drawing Sheets

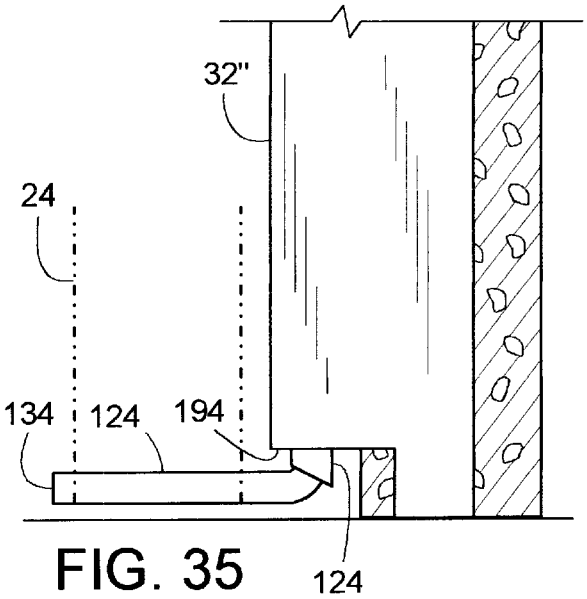
FIG. 35
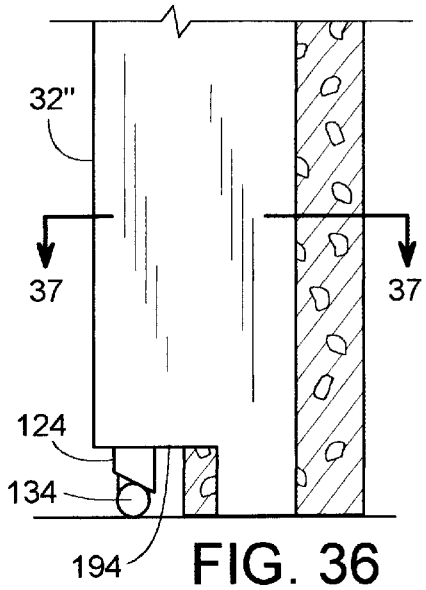
FIG. 36
FIG. 37
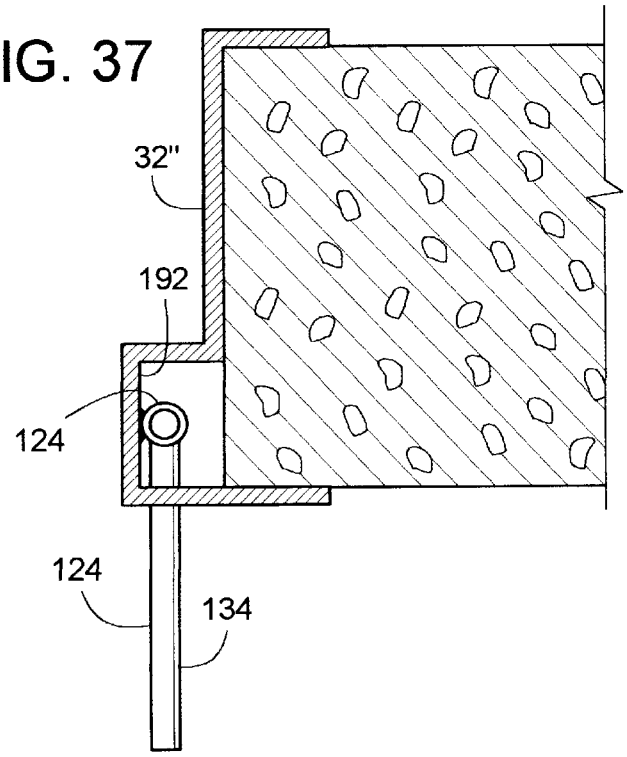

YIELDABLE GUIDE FOR A DOOR

BACKGROUND OF THE INVENTION

1. Field of the Invention

The subject invention generally pertains to doors and more specifically to a door guide that provides a door panel with a breakaway feature.

2. Description of Related Art

Industrial doors are often comprised of a fabric curtain or have one or more panels whose vertical movement between an open and closed position is guided by tracks disposed along lateral edges of a doorway. Examples of such doors include, but are not limited to roll-up doors, concertina doors, planar doors and overhead-storing doors.

A roll-up door typically includes a pliable roll-up panel or curtain that is wound about an overhead roller. The curtain often includes several spaced-apart horizontal stays or wind bars that are relatively rigid to help prevent the curtain from billowing when subject to an air pressure differential across opposite faces of the curtain. To close the door, the roller pays out the curtain as two vertical tracks disposed along either side edge of the doorway guide the side edges of the roll-up panel generally along a vertical plane across the doorway. The rotation of the roller is reversed to open the door. Roll-up doors are typically either powered open and closed, or are powered open and allowed to fall closed by gravity.

A concertina door typically includes fabric curtain similar to a roll-up door with vertically spaced horizontal bars disposed thereon. To open and close the door, vertical straps are connected to a roll-tube above the doorway and are also connected to alternating bars disposed along the curtain. Winding up of the straps lifts the bottom bar, which also picks up the bars above, while the curtain fabric folds (concertina-style) between the accumulating bars. When fully open, the bars and folded-up curtain are aggregated above the doorway. Unwinding the straps reverses the process. As with a roll-up door, the vertical movement of the curtain and bars are guided by vertical tracks disposed along each side of the doorway.

A planar door includes a door panel that remains generally planar as the panel moves vertically between its open and closed positions. When open, the door panel stores generally adjacent a wall above the doorway with the plane of the panel being parallel or at a slight angle to the wall. Again, the vertical movement of the door panel is guided by vertical tracks disposed along each side of the doorway.

An overhead-storing door includes a series of panels that are pivotally interconnected at horizontal joints. As the door closes, vertical guides along the lateral edges of the doorway guide the panels to a vertical position. When the door opens, the pivotal joints allow the panels to store horizontally overhead, as in a conventional garage door.

Industrial doors, such as the ones just described, are commonly installed in warehouses where the doors are very susceptible to being struck by forklifts or other vehicles. To protect the door and the vehicle from damage, often some type of breakaway or compliant feature is added to the door, which allows the door to move into and out of the doorway in the event of an impact. Although there are a wide variety of breakaway devices available, perhaps the most economical is one where the vertical guide comprises a flexible strap that yields to release a struck door panel.

For example, a guidance device of the published international patent application WO98/48139 (Oct. 29, 1998) employs a fabric strap as a guide or track for the vertical movement of a door panel (i.e., a curtain with or without horizontal bars, a rigid single panel or panels, etc.). If the panel is struck, the flexibility of the strap allows the panel to break out from within the guide to prevent damaging the panel or the track. Although the guide is flexible for most of its length, its lower anchor is a fixed hexagonal post that protrudes several inches into the doorway. If a forklift or the load it is carrying were to hit the post, it could permanently bend or break off entirely. Thus, the protruding post provides a hard stop that can narrow the effective width of the doorway.

SUMMARY OF THE INVENTION

In order to provide a door with a breakaway feature, in one embodiment a door guide is provided with a yieldable strap that is disposed between two anchors, wherein at least one of the anchors is moveable from a normal position to a yielded position in response to an impact. The moveable anchor may be resiliently returnable to the normal position after the impact.

In some embodiments, the lower anchor is biased to its normal position.

In some embodiments, the lower anchor is biased to its normal position by way of a spring.

In some embodiments, the lower anchor is biased to its normal position by way of a torsion bar.

In some embodiments, the lower anchor is biased to its normal position by way of tension in the strap.

In some embodiments, the lower anchor is biased to its normal position by virtue of the lower anchor consisting of a resilient polymer.

In some embodiments, the strap is held in tension by a spring.

In some embodiments, a single strap is disposed along each lateral edge of the doorway, wherein each strap loops underneath a lower anchor to provide two generally parallel strap segments between which a door panel is guided.

In some embodiments, the guide strap is of a color recognized by OSHA (Occupational Safety and Health Administration of the U.S. Department of Labor) as a safety color (e.g., yellow, orange, or red) to serve as a safety warning that identifies the proximity of a hard edge of a doorway.

In some embodiments, the guide strap includes a reflective surface to provide a clearly visible indication of the proximity of a hard edge of a doorway.

BRIEF DESCRIPTION OF THE DRAWINGS

FIG. 35 is a front view similar to FIG. 22, but with the anchor mounted to the backside of a side frame.

FIG. 36 is similar to FIG. 36, but with the anchor in a yielded position.

FIG. 37 is a cross-sectional view taken along line 37—37 of FIG. 36.

DESCRIPTION OF THE PREFERRED EMBODIMENT

Figure 1:
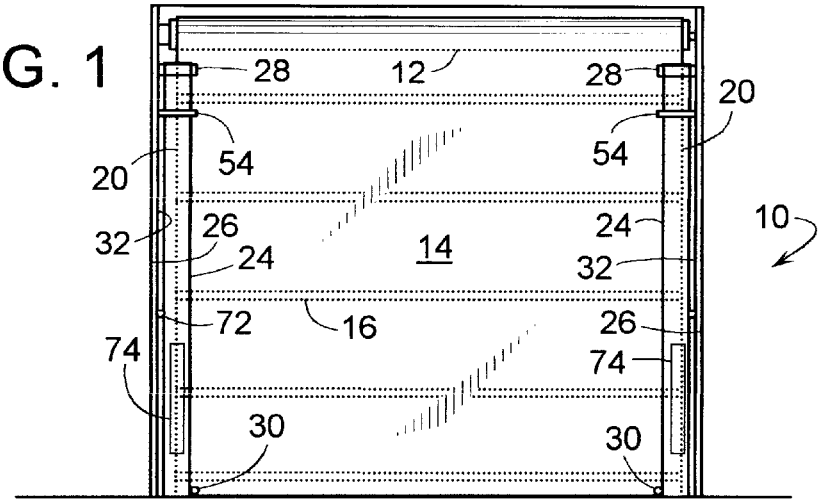
FIG. 1 is a front view of a closed door that includes a flexible door guide.
Figure 2:
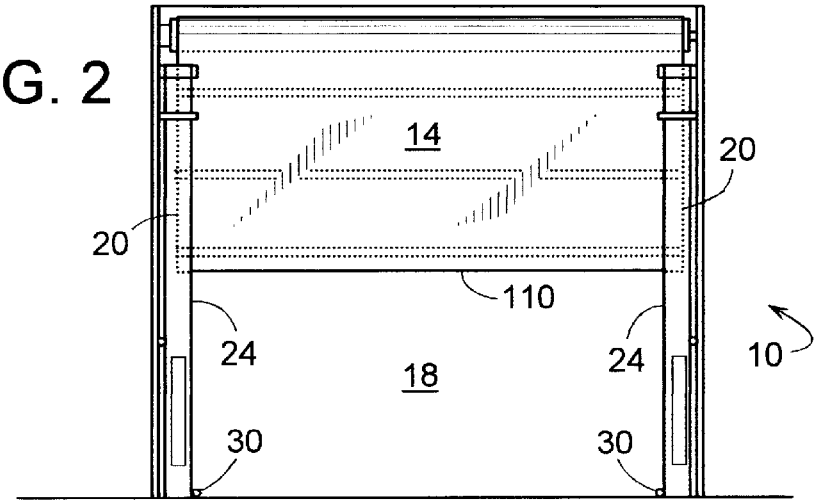
FIG. 2 is the same as FIG. 1, but with the door partially open.
Figure 3:
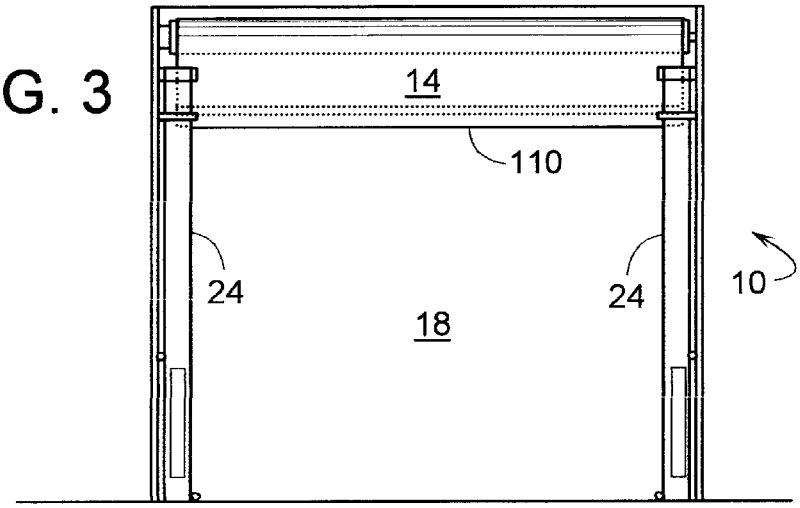
FIG. 3 is the same as FIG. 1, but with the door fully open.

An industrial door 10 is shown closed, partially open and fully open in FIGS. 1, 2 and 3, respectively. To open or close door 10, a powered roller 12 draws in or pays out a roll-up door panel 14 that is wrapped around the roller. Panel 14 preferably comprises a flexible fabric, such as conventional PVC coated, polyester-base fabric reinforced with relatively rigid stays or wind bars 16. Wind bars 16 are held in place by integral pockets that are sewn or heat welded to panel 16. It will be appreciated by one of skill in the art that the inventive concepts disclosed herein are adaptable for use with other doors besides those comprised of windbar-reinforced fabric curtains.

Figure 4:
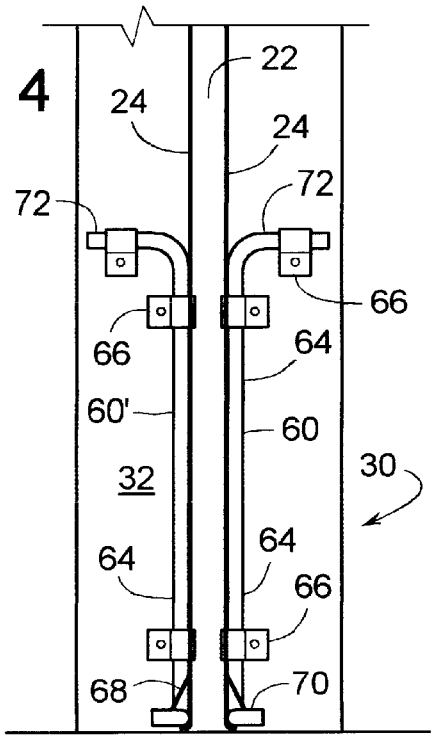
FIG. 4 is a side view of a lower anchor used in the door of FIG. 1.

To guide the panel's vertical movement across a doorway 18, each side edge 20 of panel 14 travels within a gap 22 (FIG. 4) between a pair of parallel guide straps 24. In this embodiment, guide straps 24 are held in tension along either lateral edge 26 of doorway 18. As guide straps 24 may be adapted for use with roll-up doors, they will be described with reference thereto. However, guide straps 24 are readily suitable for other doors including, but not limited to, concertina doors, planar doors and overhead-storing doors. Those skilled in the art, however, should appreciate that the other doors may need some obvious modifications in order to employ a strap-style guide. For example, when straps are used in guiding the vertical movement of an overhead-storing door panel, the upper ends of the straps should obviously lead into a more rigid track that includes a horizontal section and a curved section that directs the door from its overhead horizontal position to its vertical position. Moreover, while the embodiments depicted in the drawings are mostly directed to straps 24 being normally held in tension, the invention may not be so limited. Rather, the inventive concepts described herein may be applied to straps that are normally un-tensioned and which go into tension upon an impact on the door or other force being applied to the straps.

Figure 6:
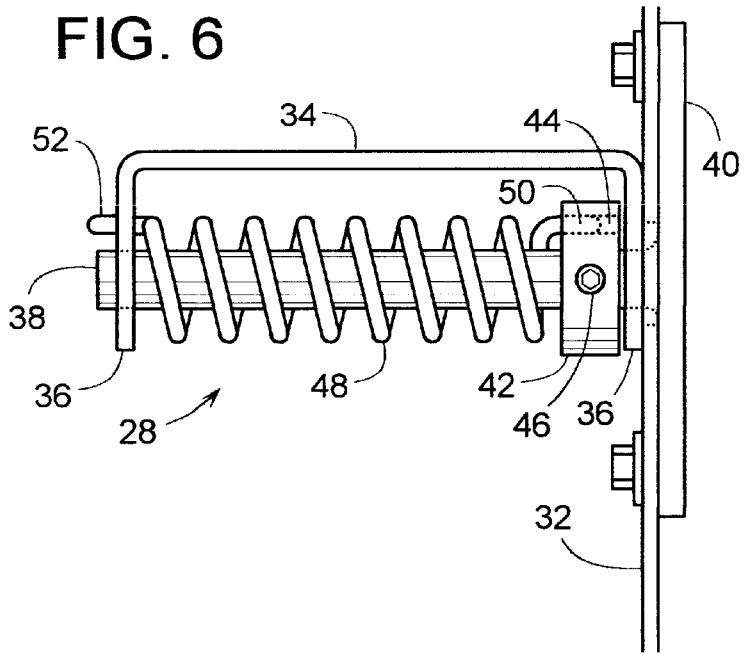
FIG. 6 is a front view of a spring-loaded upper anchor used in the door of FIG. 1.
Figure 7:
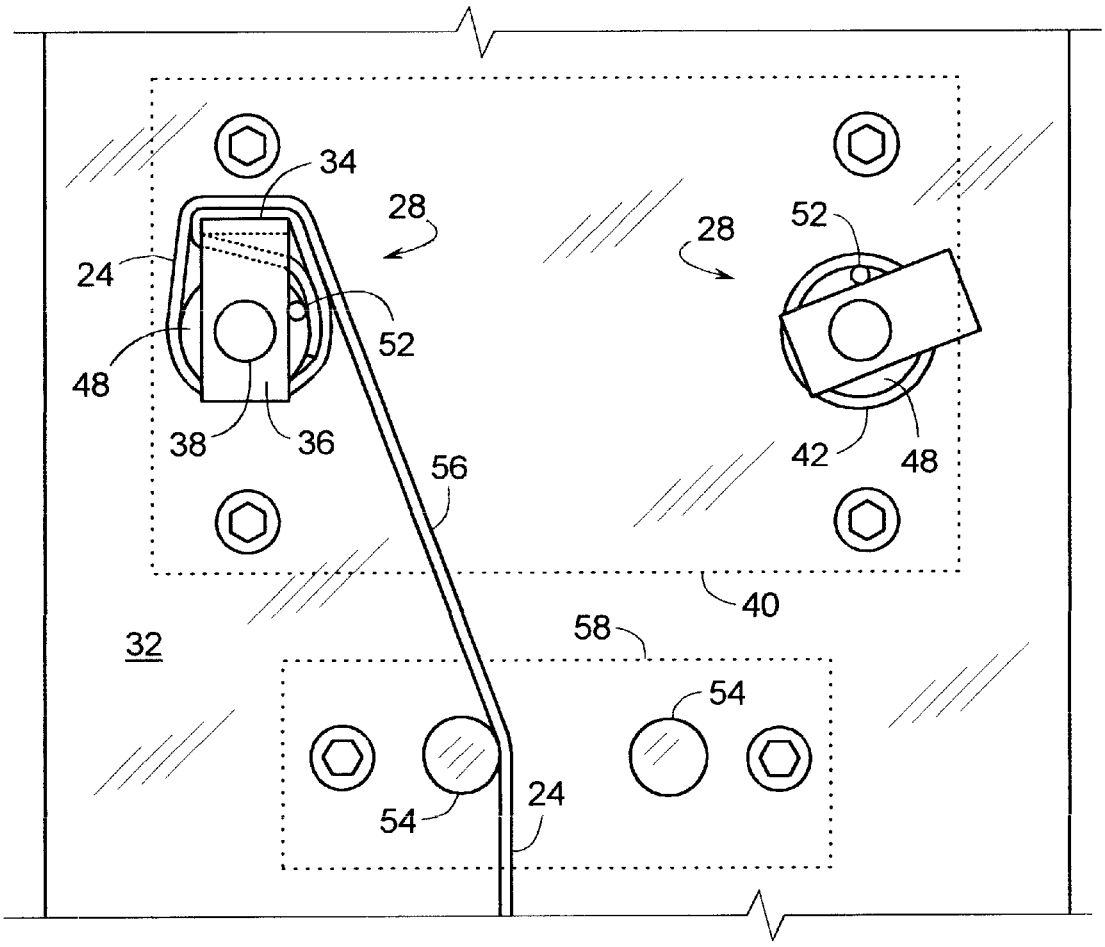
FIG. 7 is a side view of the upper anchors used in the door of FIG. 1.

Returning to the current embodiment, straps 24 are preferably made of a pliable fabric, such as nylon, that when held in tension, they have sufficient stiffness to guide the vertical movement of panel 14, yet have the flexibility to release panel 14 out from within gap 22 when a certain breakaway force 26 (FIG. 10) is applied against panel 19. To achieve the proper tension, strap 24 is stretched between an upper anchor 28 and a lower anchor 30, both of which are attached to a sheet metal side frame 32. Upper anchor 28 can be similar to the upper or lower anchors of earlier-mentioned WO98/48139, or spring-loaded as shown in FIGS. 6 and 7.

A spring-loaded anchor, upper or lower, can maintain sufficient tension in strap 24 even if the fabric tends to creep or stretch over time. A spring-loaded anchor can also keep a strap taut with use under varying conditions, such as varying temperature, humidity, and frequent panel/guide breakaways. In addition, spring-tensioning can add programmability to the breakaway. One of skill in the art will appreciate that both the "normal" tension in the strap (i.e., when no impact force is applied to the curtain) as well as the increase in tension in the strap resulting from impact can be set by selecting a given spring and/or pre-stressing of that spring. Different springs or pre-stressing will alter the response of the strap. Incidentally, alternative strap materials may alter this response as well.

Applying tension to strap 24 can be achieved in a number of ways. For example, referring to FIG. 6, upper anchor 28 includes a U-shaped bar 34 having two legs 36 that rotationally disposed about a shaft 38. Shaft 38 rigidly extends from a support plate 40 that bolts or otherwise attaches firmly to side frame 32. A shaft collar 42 with an axial hole 44 and a radial setscrew 46 grips shaft 38 to loosely hold bar 34 to shaft 38 in an axial direction. A torsion spring 48 having one end 50 engaging axial hole 44 and an opposite end 52 engaging one leg 36 of bar 34 allows bar 34 to be rotationally stressed relative to shaft 38. To achieve the desired tension in strap 24, bar 34 can be manually rotated a desired amount before one end of strap 24 is iniserted between bar 34 and shaft 38, as shown in FIG. 7. For illustrative purposes, only one of the two straps is shown in FIG. 7. If desired, shafts 54 can be added to create a tapered lead-in 56 for panel 14, to create a storage area for concertina-style panels, and/or to simply place the upper ends of straps 24 in their proper position. Shafts 54 can be mounted to side frame 32 by using a support plate 58 similar to plate 40.

In some circumstances, a strap alone may allow a door panel to break away under impact; however, the flexibility of the strap may be restricted where the strap is anchored to the edge of the doorway. Thus, one or more of the anchors that support the strap are preferably provided with some ability to move or yield in response to an impact force applied against the door panel or to the strap guide or applied against the anchor itself. Preferably, such yieldability is accompanied by the ability of the anchor to be returned to its normal position, and structure for providing such restorative force. For example, a strap anchor could pivot about a vertical axis in response to an impact, and then spring force, tension in the strap, or some other restorative force could return the anchor back to its normal operating position. Such resilient anchors can be of a variety of designs and be mounted in various ways. They can be mounted near the bottom of the doorway and/or near the top. The anchors can have a point of attachment on the door side of side frame 32 or on the backside of side frame 32.

Figure 5:
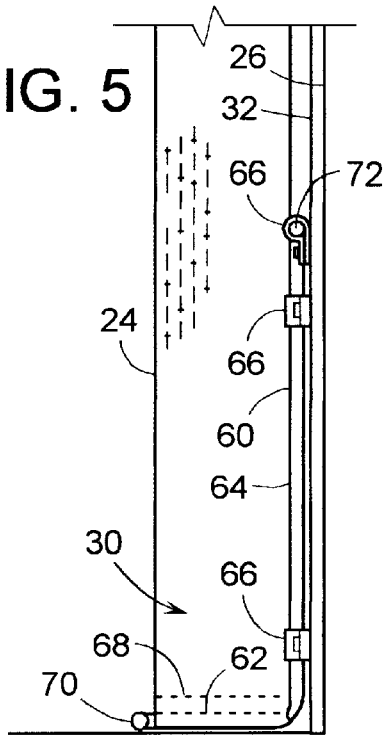
FIG. 5 is a front view of FIG. 4.
Figure 8:
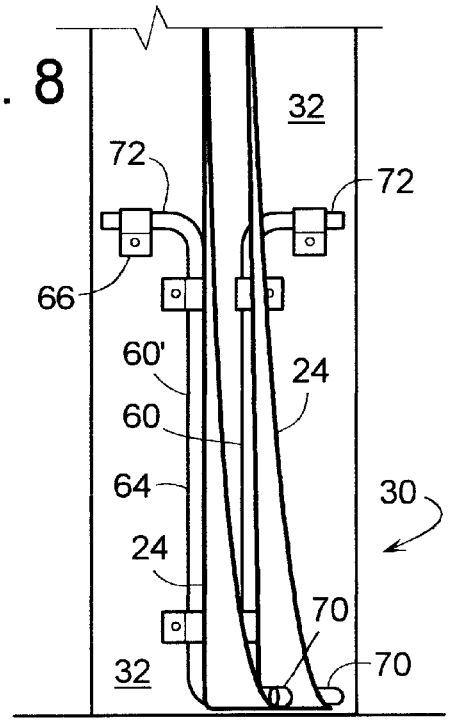
FIG. 8 is the same as FIG. 4, but with the lower anchor in a yielded position as opposed to a normal position.
Figure 9:
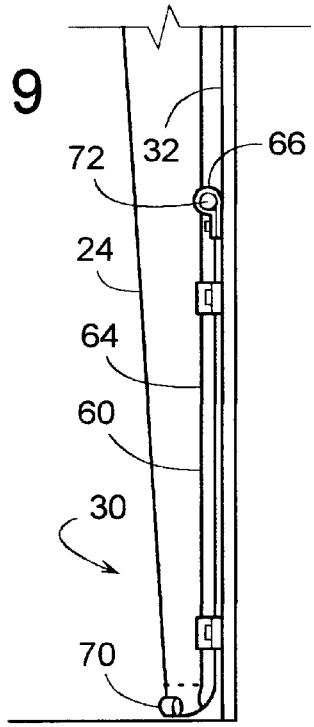
FIG. 9 is the same as FIG. 5, but with the lower anchor in a yielded position as opposed to a normal position.

To provide a lower anchor that resiliently yields when struck, in one embodiment a lower anchor 30 comprises two steel rods 60 and 60' that are a mirror image of each other, and each are formed to include a pivotal arm 62 and an integral torsion bar 64. Several strap clamps 66 attach rods 60 and 60' to side frame 32. Strap 24 includes a lower loop 68 that slips around arm 62, while an offset end 70 of rods 60 and 60' help keep strap 24 from slipping back off. An upper horizontal segment 72 helps hold rods 60 and 60' at their proper height and also rotationally fixes the upper end of torsion bar 64. Although the upper end of torsion bar 64 is fixed, strap clamps 66 have sufficient radial clearance to allow the remainder of torsion bar 64 to twist resiliently (i.e., elastic strain). The radial clearance can be achieved by having slightly oversized strap clamps, or by having clamps 66 tighten about a bushing that has a slip-fit clearance to rods 60 and 60'. Torsion bar 64 being able to twist resiliently allows arm 62 to pivot when struck and then spring back to its original position after the striking force is removed. This action allows lower anchor 30 to be moveable from a normal position (FIGS. 4 and 5), to a yielded position in response to an impact (FIGS. 8 and 9), and then returnable back to its normal position. In one embodiment, torsion bar 64 is about 4-feet long with a 0.25-inch diameter, and pivotal arm 62 is about 4.5 inches long, and may be reinforced with an appropriate brace or gusset if desired. However, various other dimensions may be used depending on numerous factors including material properties, strap width, strap tension, and the desired spring-back of the pivotal arm.

Lower anchor 30 being moveable renders strap 24 yieldable down to its lowest point. Thus, strap 24 can serve as a yieldable standoff that may keep vehicles a safe distance away from an unyielding hard edge, such as edge 26 of doorway 18. Toward that end, strap 24 may be provided in a safety color. Yellow, for example, is recognized by OSHA as a color to indicate the presence of a striking hazard. Other bright or fluorescent colors such as red and orange, or a reflective surface 74, such as reflective tape, may also provide an effective visual warning.

Figure 10:
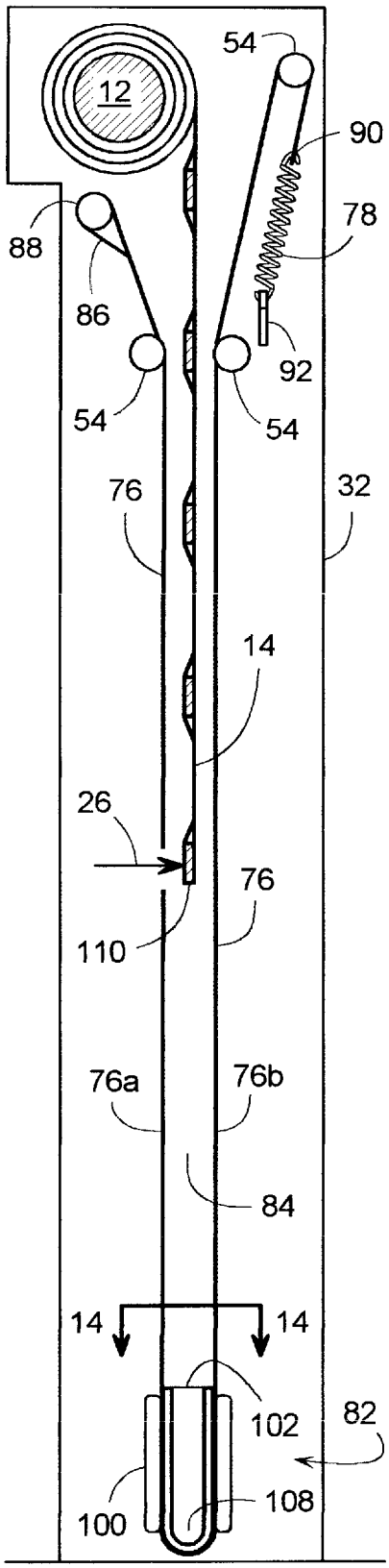
FIG. 10 is a cross-sectional view taken along line 10—10 of FIG. 11.
Figure 11:
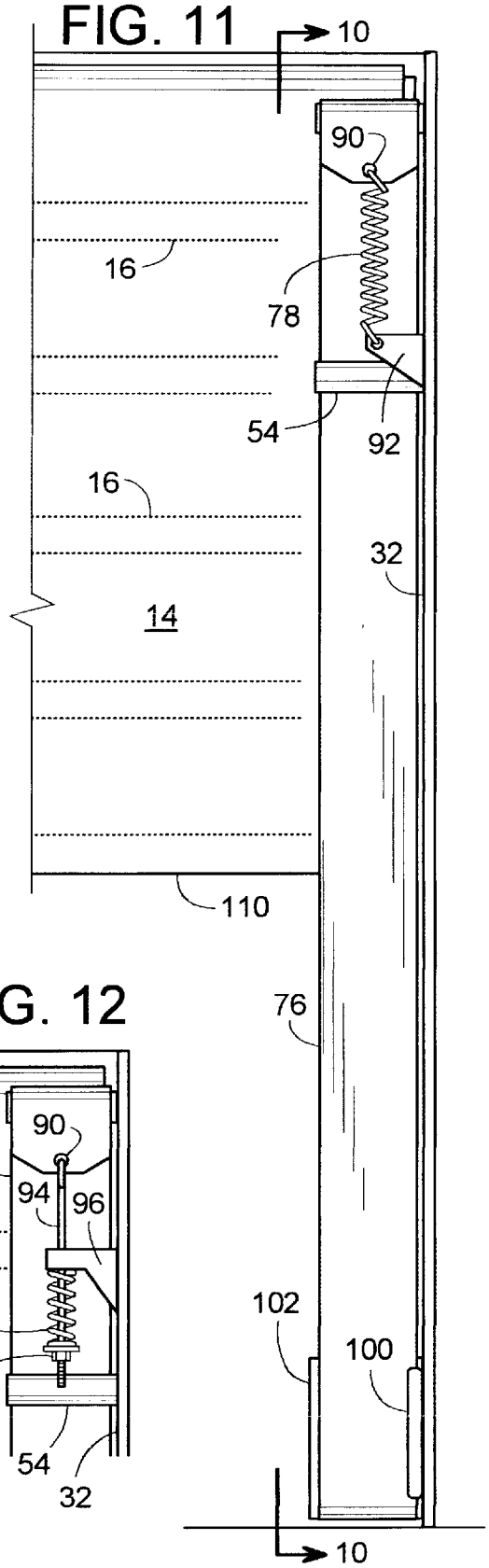
FIG. 11 is a partial front view of another door that includes a guide strap and a spring to tighten the strap.
Figure 12:
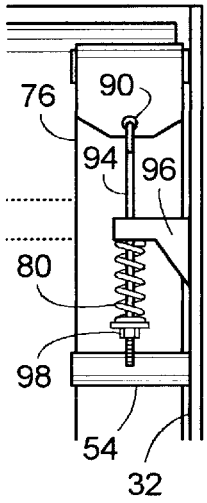
FIG. 12 is a partial front view similar to FIG. 11, but showing an alternate spring.

In alternate embodiments, the tension in a guide strap 76 is provided by a tension spring 78, as shown in FIGS. 10 and 11, and alternately provided by a compression spring 80, as shown in FIG. 12. In either case, strap 76 can be a single strap that loops underneath a lower anchor 82 to create two generally parallel strap segments **76*a* and 76*b* that are integral extensions of each other. Door panel 14 can then travel vertically along a gap 84 between strap segments 76*a* and 76*b*. One end of strap 76 includes a loop 86 held stationary by an upper anchor 88, such as a shaft similar to shaft 54. An opposite end of strap 76 includes a point 90 connected to one end of spring 78, with an opposite end of spring 78 being connected to a stationary bracket 92 that is attached to side frame 32. Thus, spring 78 pulling on point 90 creates tension in both strap segments 76*a* and 76*b*. This may advantageously allow strap 76** to be formed of a less resilient (and perhaps less expensive) material than in other embodiments, as the spring provides the resiliency.

To readily adjust the tension in strap 76, refer to the embodiment of FIG. 12. Here, an eyebolt 94 connects point 90 to a bracket 96 that is fixed to side frame 32. Compression spring 80 pushes between bracket 96 and a nut 98 on eyebolt 94 to apply tension to strap 76. Tightening or loosening nut 98 adjusts the tension in strap 76.

Figure 13:
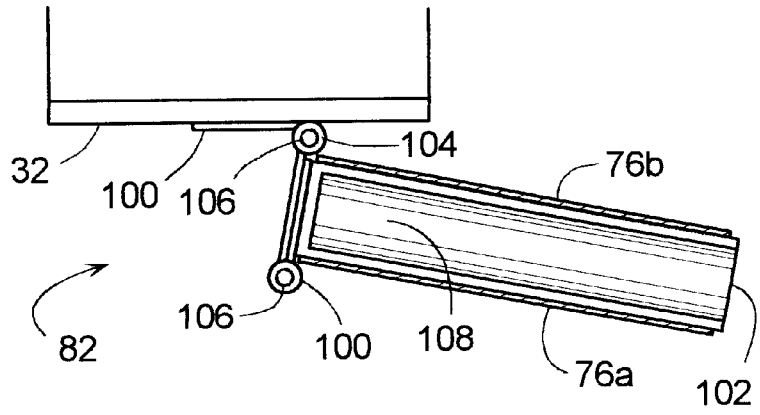
FIG. 13 is a top view of the lower anchor of the door shown in FIG. 10, but with the anchor in one of its yielded positions.
Figure 14:
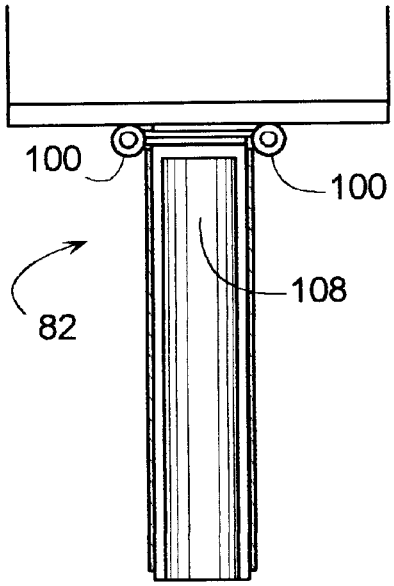
FIG. 14 is a cross-sectional top view taken along line 14—14 of FIG. 10, and is the same as FIG. 13 but with the lower anchor in its normal position as opposed to its yielded position.
Figure 15:
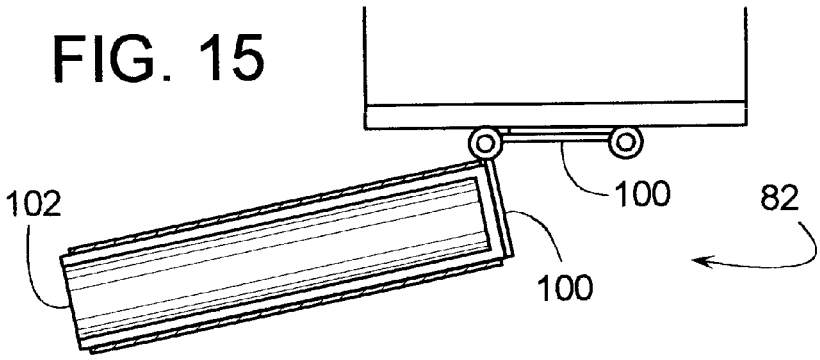
FIG. 15 is the same as FIG. 13, but with the lower anchor in another yielded position.

Although springs 78 and 80 are readily adapted to various strap configurations (e.g., single or dual straps) and various lower anchors (e.g., single or dual arms), in one embodiment, lower anchor 82 includes a conventional double-acting spring hinge 100 that pivotally mounts a single arm 102 to side frame 32. Hinge 100 inherently includes an internal torsion spring 104 disposed about each hinge pin 106. Torsion springs 104 urge arm 102 to its normal position of FIGS. 10, 11 and 14, but also allows arm 102 to move to yielded positions in either direction by pivoting about either hinge pin 106, as shown in FIGS. 13 and 15. Although double-acting spring hinge 100 could be of any suitable size or make, in one embodiment, hinge 100 is identified as a catalog part number 1479A23 of McMaster-Carr of Chicago, Ill. Arm 102, which extends from hinge 100, has a U-shaped cross-section to provide a low cavity 108 into which a lower edge 110 of panel 14 may travel. The smooth U-shape underneath arm 102 also allows the tension in one strap segment **76*a* to be transferred to the other strap segment 76*b*, which allows the use of one spring 78 or 80** to tighten both strap segments.

Figure 16:
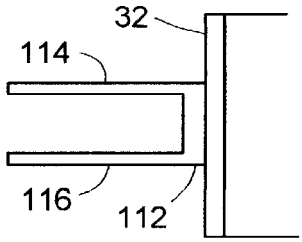
FIG. 16 is a top view of a polymeric lower anchor.
Figure 18:
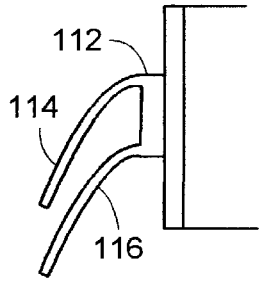
FIG. 18 is the same as FIG. 16, but with the anchor in a yielded position.
Figure 17:
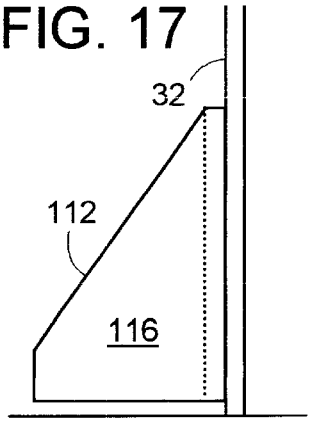
FIG. 17 is a front view of the anchor of FIG. 16.
Figure 19:
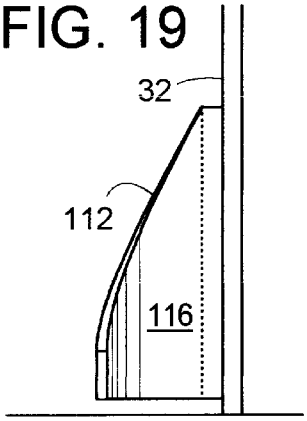
FIG. 19 is the same as FIG. 17, but with the anchor in the yielded position.

Various other designs of an anchor that is moveable between a normal position and a yielded position are well within the scope of the invention. For example, a lower anchor 112, of FIGS. 16–19, consists of a flexible polymer, such a polyurethane, polypropylene, rubber, etc. The shape of anchor 112 is such that it provides ample strength and rigidity in a vertical direction to maintain tension in a guide strap, yet is sufficiently thin horizontally to resiliently flex from a normal position (FIGS. 16 and 17) to a yielded position (FIGS. 18 and 19) and then return to its normal position. Lower anchor 112 could be used as a dual arm anchor, wherein separate straps are individually attached to arms 114 and 116. The straps can be attached to arms 114 and 116 by any conventional fastener including, but not limited to, screws, hooks, rivets, and adhesive.

Figure 20:
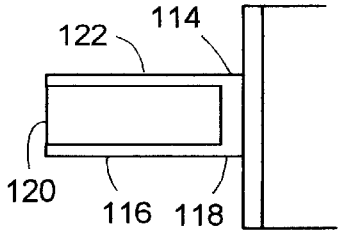
FIG. 20 is a top view of another polymeric lower anchor.
Figure 21:
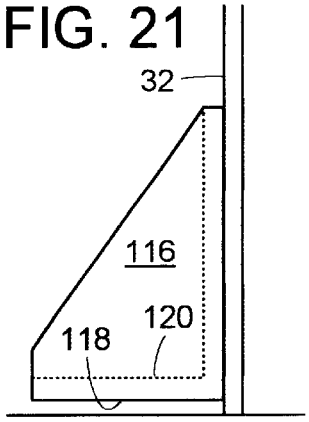
FIG. 21 is a front view of the anchor of FIG. 20.

FIGS. 20 and 21 illustrate another anchor 118 that is similar to anchor 112, but includes an integral bottom portion 120, which allows a single strap to loop underneath anchor 118 without the strap pinching arms 114 and 116 together. Anchor 118 defines a cavity 122 that provides a function similar to that of cavity 108 of anchor 82.

Figure 22:
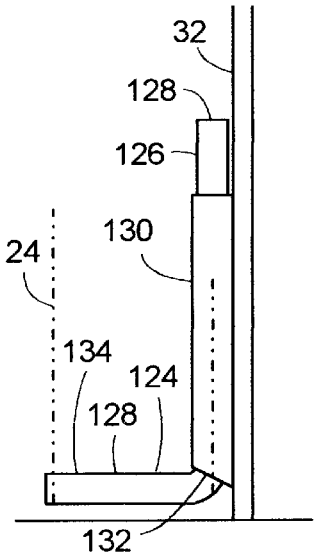
FIG. 22 is a front view of a cam-actuated lower anchor.
Figure 23:
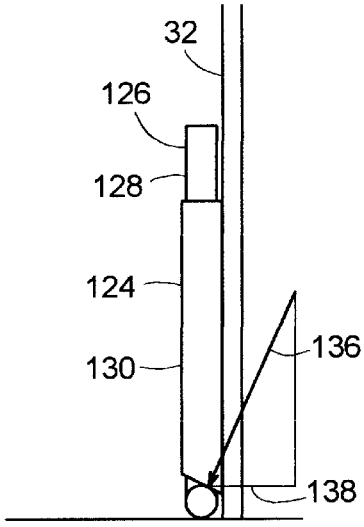
FIG. 23 is the same as FIG. 22, but with the anchor in a yielded position.

FIGS. 22 and 23 illustrate yet another embodiment of an anchor 124. In this example, a vertical leg 126 of an L-shaped arm 128 is journalled within a fixed sleeve 130 having a beveled lower edge 132, such that edge 132 serves as a cam surface that urges a horizontal leg 134 of arm 128 to its normal position (FIG. 22). An external force or impact can move arm 128 to a yielded position (FIG. 23); however, tension in guide strap 24 looped underneath leg 134 pulls leg 134 against beveled edge 132 to create a reaction force 136 between leg 134 and edge 132. A horizontal component 138 of reaction force 136 is what urges anchor 124 to its normal position. If desired, reaction force 136 can be increased by adding a spring, such as a tension spring 140, which pulls upward on L-shaped arm 128. One of skill in the art will appreciate that cam surface 132 may not be required in this embodiment, assuming other structure is present to provide the restorative force to return anchor 124 to its normal position from the yielded position. Moreover, with lower anchor 124 (as well as other lower anchors already described) the magnitude of force 126 (FIG. 10) that is needed to dislodge edge 20 (FIG. 1) out from within gap 84 is higher when door panel 14 is at its closed position (FIG. 1) than when at its intermediate position (FIG. 2), because of the proximity of edge 20 to the lower anchor. Having a door that is more difficult to forcibly break open when in its fully closed position may be desirable for security reasons in some applications.

Figure 27:
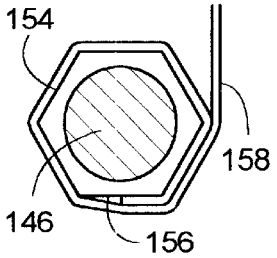
FIG. 27 is a cross-sectional view taken along line 27—27 of FIG. 25.

In another embodiment, shown in FIGS. 25–29, an anchor 142 has an attachment point disposed on the backside of a side frame 32' and includes a compression spring 144 that urges anchor 142 to its normal, outwardly extended position. That is, in the normal position, the anchor 142 includes a centerline 162. While the anchor is yieldable by rotation about a generally vertical axis (as in previous embodiments), this embodiment is characterized by the restorative force being applied longitudinally along centerline 162. Anchor 142 includes a central shaft 146 having a shoulder 148 at one end 150 and a threaded portion 152 at an opposite end. A sleeve 154 slipped over shaft 146 includes external flats or an outer surface 156 that is knurled, roughened or otherwise suitable for gripping a strap 158 upon strap 158 being wrapped around sleeve 154 (FIG. 27). A nut 160 tightened on shaft 146 clamps sleeve 154 between nut 160 and shoulder 148. This helps prevent strap 158 from unwrapping off of sleeve 154 by preventing sleeve 154 from rotating relative to shaft 146.

Figure 28:
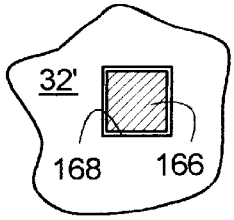
FIG. 28 is a cross-sectional view taken along line 28—28 of FIG. 25.

To help prevent shaft 146 from rotating about its longitudinal centerline 162, shaft 146 is coupled to a linkage assembly 164. Assembly 164 includes an elongated square bar 166 whose rotation is limited upon extending through a mating square hole 168 in side frame 32' (FIG. 28). A short link 170 is pivotally pinned to bar 166 and shaft 146 by way of pins 172 and 174 respectively. Other structure for securing a strap to anchor 142, and/or preventing rotation thereof could also be employed.

Figure 25:
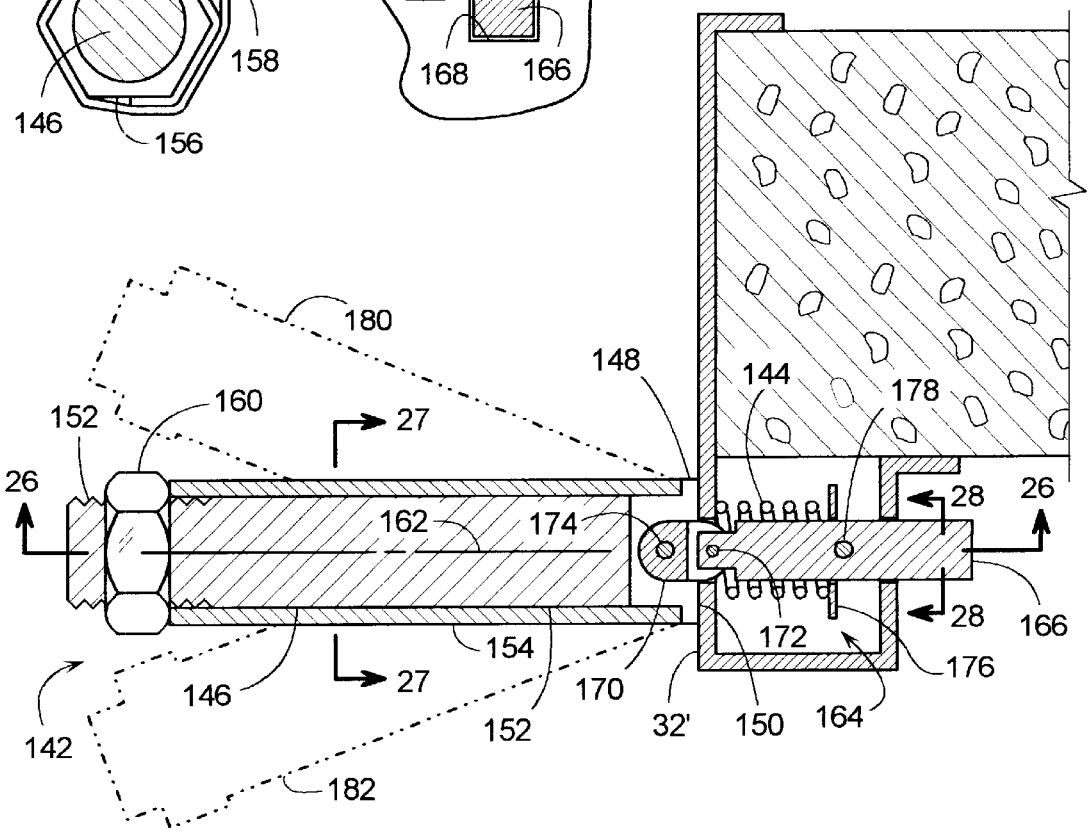
FIG. 25 is a cross-sectional view of a yieldable anchor taken along line 25—25 of FIG. 26.
Figure 26:
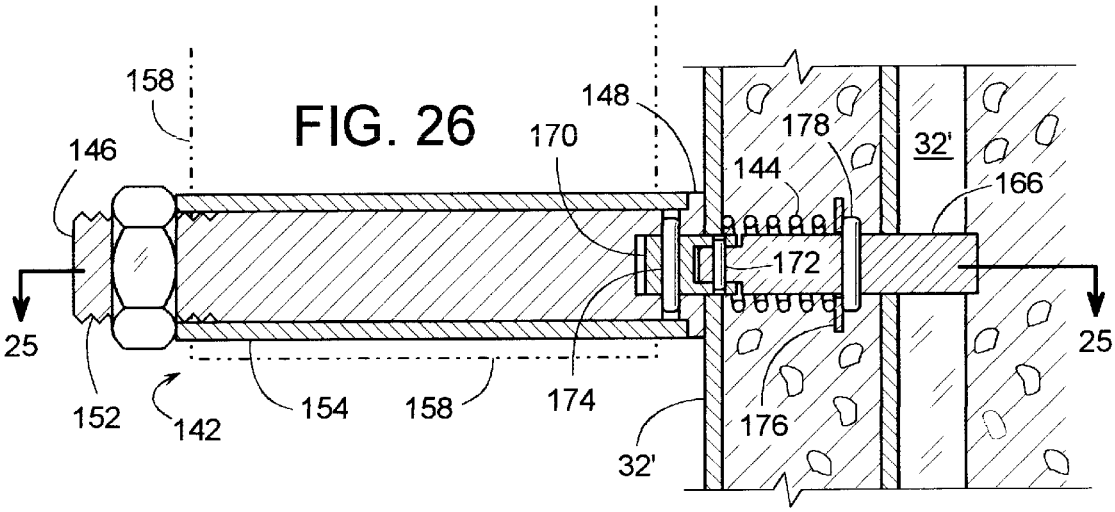
FIG. 26 is a cross-sectional view taken along line 26—26 of FIG. 25.
Figure 29:
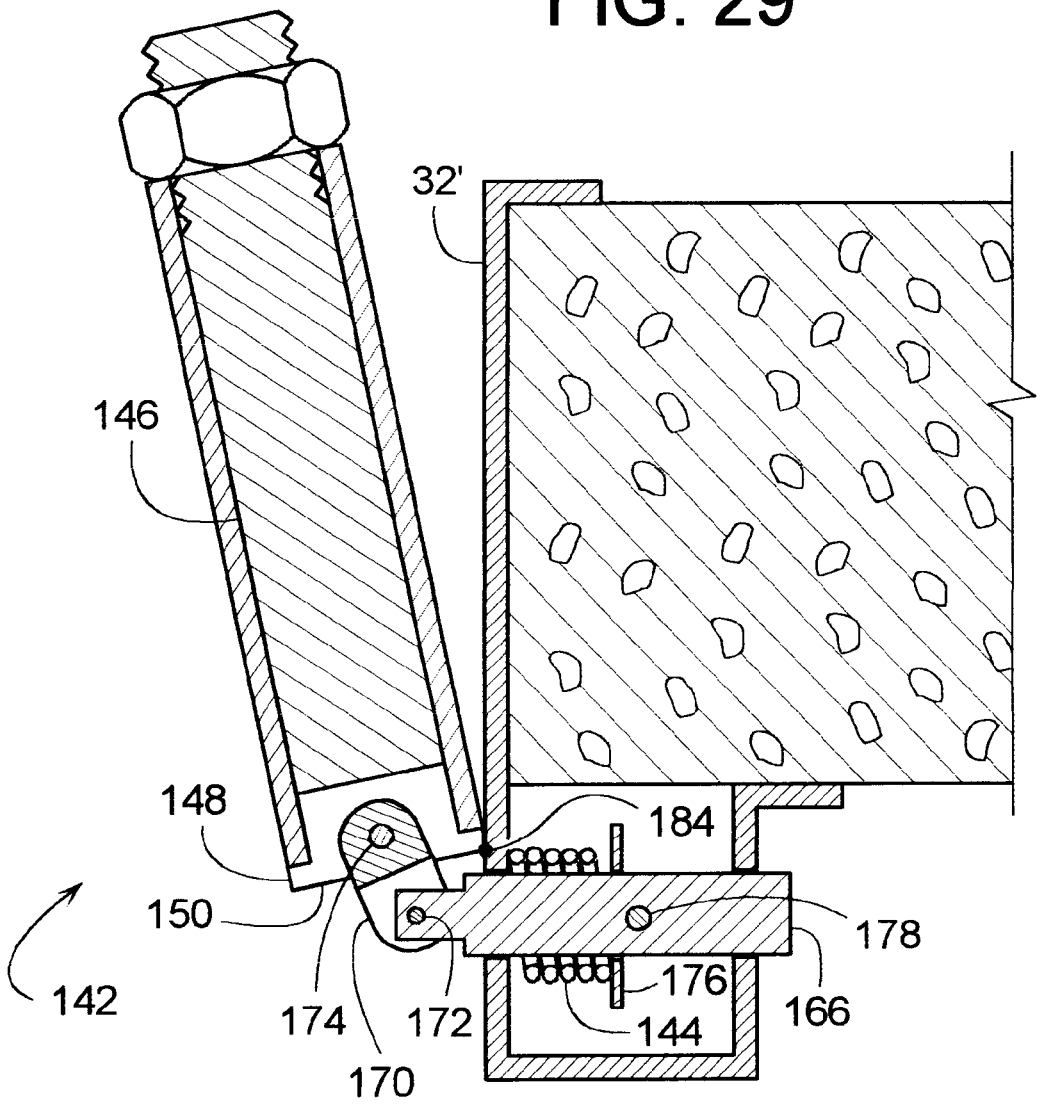
FIG. 29 is similar to FIG. 25, but with the anchor in a yielded position.
Figure 30:
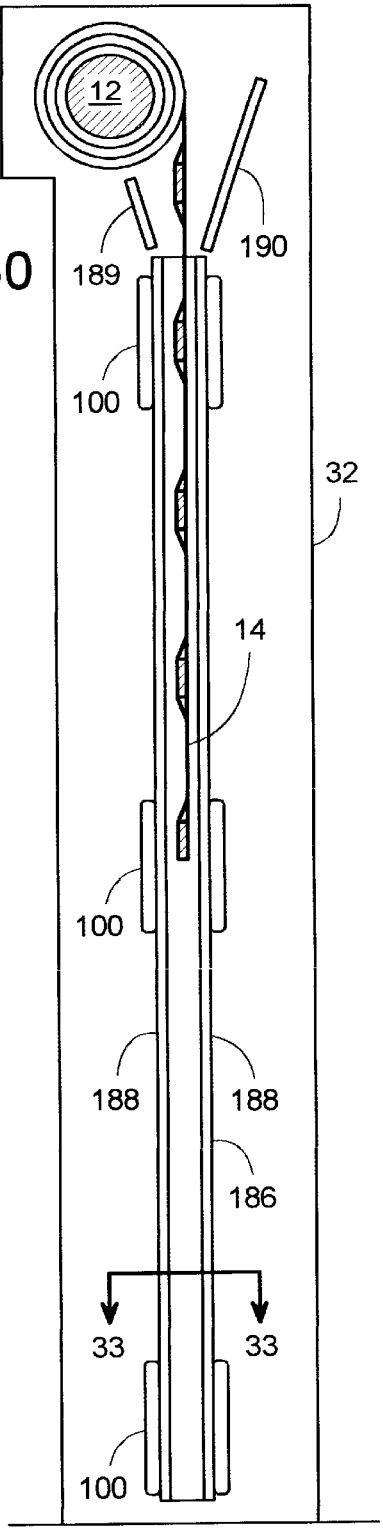
FIG. 30 is a cross-sectional view taken along line 30—30 of FIG. 31.
Figure 31:
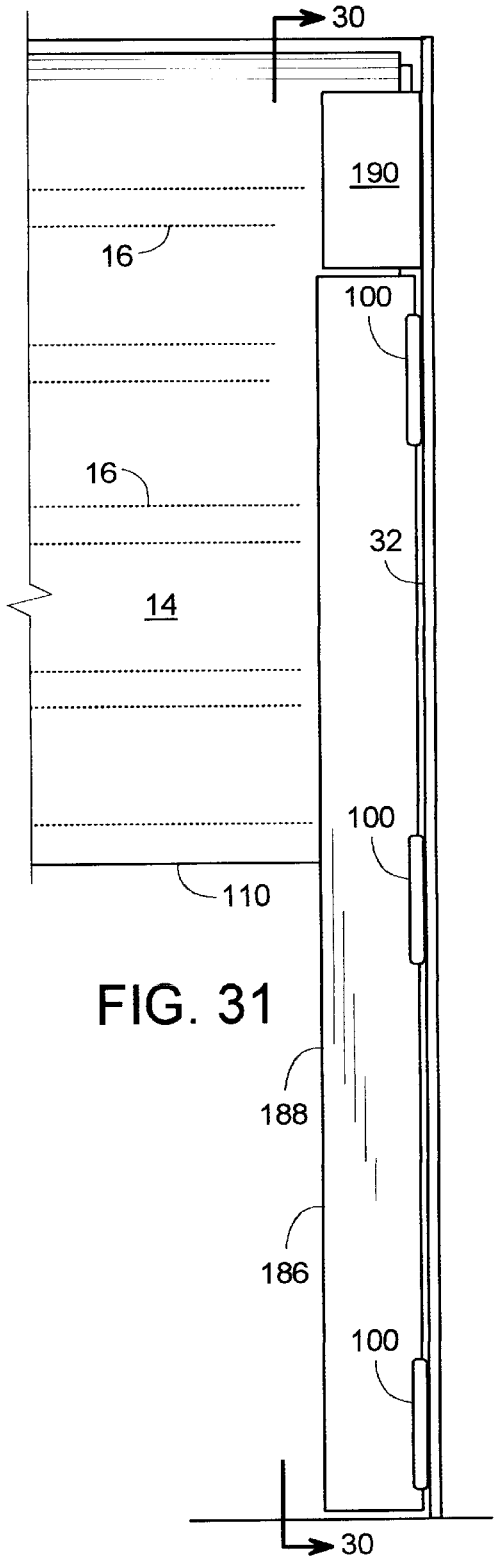
FIG. 31 is a partial front view of another door that includes a relatively rigid side panel, such as a guide strap made of sheet metal.
Figure 32:
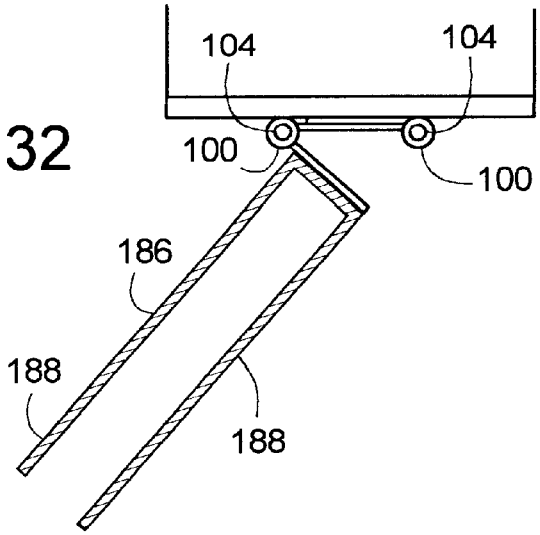
FIG. 32 is a cross-sectional top view of the embodiment shown in FIGS. 30 and 31, but with the side panel in one of its yielded positions.
Figure 33:
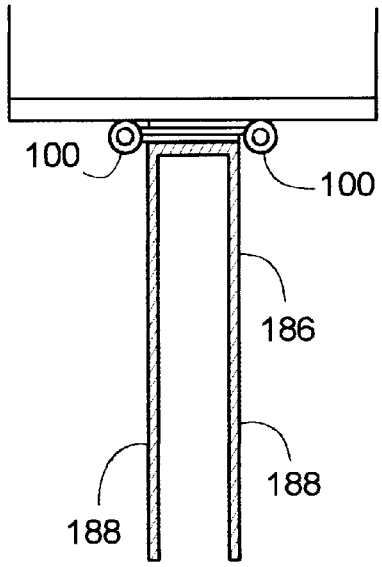
FIG. 33 is a cross-sectional top view taken along line 33—33 of FIG. 30, and is similar to FIG. 32, but with the side panel in its normal position as opposed to its yielded position.
Figure 34:
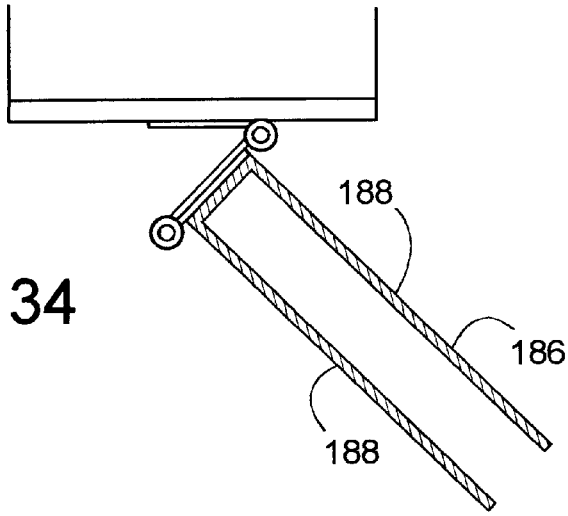
FIG. 34 is similar to FIG. 32, but with the side panel in another yielded position.

To urge anchor 142 to its normally extended position, of FIGS. 25 and 26, compression spring 144 urges bar 166 to the right, as viewed in the drawings. Spring 144 does this by pushing against the backside of side panel 32' and against a washer 176 that is fixed relative to bar 166 by way of a third pin 178. Bar 166 being pushed to the right pulls shaft 146 firmly against side panel 32'. The flat face of shaft end 150 being pressed against side frame 32' tends to keep shaft 146 generally perpendicular to side frame 32'.

However, in response to an impact against the door, strap 158 or anchor 142, vertically extending pins 172 and 174 allow shaft 146 to pivot about a vertical axis to various yielded positions, as indicated by phantom lines 180 and 182. In moving to the position of FIG. 29, the pivotal movement of shaft 146 about a sliding point 184 pulls link 170 away from side panel 32'. This forces pin 178 of bar 166 to further compress spring 144 between washer 176 and the backside of side panel 32'. The further compression of spring 144 is what causes anchor 142 to return to its normally extended position after the impact.

According to an alternative embodiment, the "guide strap" need not be a strap at all, but rather could be formed of a rigid material such as metal. In such an instance, the rigid guide member would be yieldable in a similar manner to the yieldable strap anchors discussed herein-illustratively by rotation about a generally vertical axis. While two independently-movable rigid guide members could be provided, the embodiment of FIGS. 30–34 shows the two guide members being unitary. That is, the vertical edges of door panel 14 each travels within a U-shaped channel 186 that includes at least one sheet metal side panel 188. This embodiment is similar to that of FIGS. 10–15, with the primary difference being panel 188 instead of strap 76 being used for guiding door panel 14. Double-acting spring hinge 100 pivotally connects channel 186 to side frame 32. In response to an impact, channel 186 can pivot from its normal position of FIG. 33 to either of its yielded positions of FIGS. 32 and 34. After channel 186 has yielded to an impact, torsion springs 104 of hinge 100 urges channel 186 back to its normally extended position. Members 189 and 190 serve as a lead-in for door panel 14 to enter channel 186.

Figure 24:
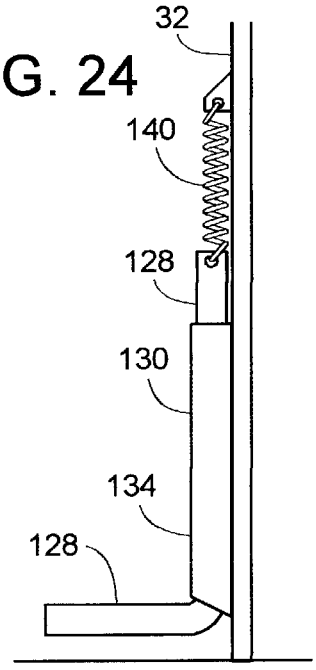
FIG. 24 is a front view of a spring-loaded, cam-actuated lower anchor.

In another embodiment, similar to those of FIGS. 22–24, anchor 124 is attached to a backside 192 of a side frame 32" to minimize the gap between strap 24 and side frame 32", to create a cleaner appearance, and to minimize encroachment of anchor 124 into the door opening. To allow leg 134 a sufficient range of pivotal movement from its normal position of FIG. 35 to a yielded position of FIGS. 36 and 37, side frame 32" includes a notched-out portion 194 that provides clearance for leg 134.

Although the invention is described with reference to a preferred embodiment, it should be appreciated by those skilled in the art that various modifications are well within the scope of the invention. For example, the various lower anchors just described are readily adapted for use as single or dual-arm anchors, wherein a single strap loops underneath a single-arm anchor to create two parallel strap segments with a door panel gap therebetween (e.g., FIG. 10), and a dual-arm anchor includes two discrete arms adapted to attach to two separate, parallel guide straps (e.g., FIG. 4). In other words, installing two single-arm anchors side-by-side creates a dual-arm anchor, and eliminating half of a dual-arm anchor creates a single-arm anchor. Of course, some dimensional changes may be needed. Although the various resilient anchors for a strap are primarily described with reference to a lower anchor, the anchors can also be mounted near the top of the doorway. Also, for the various springs used to tighten a guide strap, a single spring can be used to tighten two parallel segments of a single long strap (e.g., FIG. 10), or two springs can be used with one on either end of the strap (e.g., FIG. 7 when used with the lower anchor of FIG. 10). Thus, various lower anchors and various strap-tensioning springs can be combined and interchanged to create numerous embodiments that are all well within the scope of the invention. Therefore, the scope of the invention is to be determined by reference to the claims that follow.

We claim:

1. A door guide for a door panel that, in a lowered position, is adjacent a side frame, the door guide comprising:

a first anchor moveable from a normal position to a yielded position in response to an impact, the first anchor being mounted adjacent the side frame such that movement of the first anchor from the normal position creates a restorative force, where the first anchor is returnable to the normal position from the yielded position by the restorative force;

a first strap mounted to the first anchor and extending between the first anchor and a second anchor adjacent the door panel to guide the door panel; and a second strap running substantially parallel to the first strap to define a gap through which the door panel is adapted to travel.

2. The door guide of claim 1, wherein the second anchor is moveable from a second normal position to a second yielded position in response to the impact, and wherein the second anchor is mounted adjacent the side frame such that movement of the second anchor from the second normal position creates a second restorative force, where the second anchor is returnable to the second normal position from the second yielded position by the second restorative force.

3. The door guide of claim 1, wherein at least one of the first strap and the second strap comprises a flexible fabric.

4. The door guide of claim 1, wherein the first strap and the second strap are an integral extension of each other to comprise a unitary strap.

5. The door guide of claim 1, wherein the first anchor is biased to the normal position.

6. The door guide of claim 5, wherein the first anchor includes a torsion bar that biases the first anchor to the normal position.

7. The door guide of claim 5, further comprising a spring that biases the first anchor to the normal position.

8. The door guide of claim 7, wherein the spring is a torsion spring.

9. The door guide of claim 7, wherein the spring is a compression spring.

10. The door guide of claim 7, wherein the spring is an extension spring.

11. The door guide of claim 1, wherein the first anchor at least partially comprises a flexible, resilient polymer that urges the first anchor to the normal position.

12. The door guide of claim 1, further comprising a spring coupled to the first strap to place the first strap in tension.

13. The door guide of claim 12, wherein the spring is a compression spring.

14. The door guide of claim 12, wherein the spring is an extension spring.

15. The door guide of claim 12, wherein the spring is a torsion spring.

16. The door guide of claim 1, wherein the first strap is held in tension with a force that increases as the first anchor moves from the normal position to the yielded position, whereby the increased tension in the first strap urges the first anchor to the normal position.

17. The door guide of claim 1, wherein the first anchor includes a pivotal arm and a cam surface, wherein the first strap engages the pivotal arm and the pivotal arm moves along the cam surface upon the first anchor moving between the normal position and the yielded position, and wherein the pivotal arm engaging the cam surface urges the first anchor to the normal position.

18. The door guide of claim 1, wherein at least a portion of the first strap and at least a portion of the second strap are an OSHA safety color including at least one of yellow, orange and red.

19. The door guide of claim 1, wherein at least one of the first strap and the second strap includes a reflective surface.

20. A door guide for a door panel, comprising a side structure being pivotal about a substantially vertical axis between a normal position and a yielded position and having a hinge mechanism coupled to a side frame adjacent the door guide and coupled to the side structure for biasing the side structure to the normal position, wherein the side structure is adapted to guide the door panel when the side structure is in the normal position and at least partially releases the door panel when the side structure is in the yielded position.

21. The door guide of claim 20, wherein the side structure has a vertical length and the side structure is pivotal about the substantially vertical axis along the entire vertical length.

22. The door guide of claim 20, wherein the side structure is further pivotal to an opposite yielded position with the normal position being between the yielded position and the opposite yielded position.

23. The door guide of claim 20, wherein the side structure comprises a first side panel and a second side panel positioned such that the first and second side panels define a channel for at least a portion of the door panel.

* * * * *

UNITED STATES PATENT AND TRADEMARK OFFICE

CERTIFICATE OF CORRECTION

PATENT NO. : 6,574,832 B1
DATED : June 10, 2003
INVENTOR(S) : Boerger et al.

It is certified that error appears in the above-identified patent and that said Letters Patent is hereby corrected as shown below:

Column 3,
Line 59, please delete "Fig. 36 is similar to Fig. 36" and insert -- Fig. 36 is similar to Fig. 35 --.

Column 4,
Lines 63-64, please delete "that rotationally disposed about a shaft" and insert -- that are rotationally disposed about a shaft --.

Column 5,
Line 5, please delete "iniserted" and insert -- inserted --.

Signed and Sealed this

Twentieth Day of January, 2004

JON W. DUDAS
*Acting Director of the United States Patent and Trademark Office*